US006209226B1

(12) United States Patent
Squadroni

(10) Patent No.: US 6,209,226 B1
(45) **Date of Patent: *Apr. 3, 2001**

(54) SELF-CLEANING, SHOCK-RESISTANT SOLE FOR VENTILATED SHOES

(76) Inventor: Onifares Elpidio Squadroni, 62012 Civitanova Marche, Macerata (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/055,923

(22) Filed: Apr. 7, 1998

(30) Foreign Application Priority Data

Apr. 11, 1997 (IT) ..... RM97A0208

(51) Int. Cl.[7] ..... A43B 7/08; A43B 13/20

(52) U.S. Cl. ..... 36/3 B; 36/28; 36/29; 36/141

(58) Field of Search ..... 36/3 B, 29, 28, 36/141, 35 B

(56) References Cited

U.S. PATENT DOCUMENTS 2,090,881 * 8/1937 Wilson .
3,533,171 * 10/1970 Motoki .
3,608,215 * 9/1971 Fukuoka .
4,071,963 * 2/1978 Fukuoka .
4,118,878 * 10/1978 Semon .
4,223,456 * 9/1980 Cohen .
4,547,978 * 10/1985 Radford .
4,654,982 * 4/1987 Lee .

FOREIGN PATENT DOCUMENTS

109770 * 1/1928 (DE) .
474016 * 3/1929 (DE) .
3010824 10/1981 (DE) .
8312206 9/1983 (DE) .
0780063 6/1997 (EP) .
9201398 2/1992 (WO) .

* cited by examiner

*Primary Examiner*—Ted Kavanaugh
(74) *Attorney, Agent, or Firm*—Stevens, Davis, Miller & Mosher, LLP

(57) ABSTRACT

A shoe sole (A) comprising a fixed insole (B) provided with a series of holes, wherein there is provided a plurality of resilient hollow air chambers extending through the whole thickness of the sole, said chambers having an upper portion with hemispheric shape and circular plan which supports the fixed insole, and a lower portion forming the tread. The shape of such air chambers or spacers is similar to that of an igloo with a central hole (1, 1') at the top. In order to perform a shock-resistant action there are provided conical protrusions (6) projecting from the base of each igloo towards the respective upper hole (1) so that when the walls (2, 5) are deflected by the user's weight, each protrusion (6) will occlude the corresponding hole (1) before all of the air contained in the igloo escapes.

22 Claims, 3 Drawing Sheets

SELF-CLEANING, SHOCK-RESISTANT SOLE FOR VENTILATED SHOES

FIELD OF THE INVENTION

The present invention relates to shoes, particularly to a sole capable of providing an effective ventilation and massage of the user's foot during walking.

BACKGROUND OF THE INVENTION

There are known to be a number of moulded soles for shoes comprising resilient chambers located both on the upper surface of the sole so as to contact the insole underneath the foot and projecting downwards from the sole so as to act as a tread. Such chambers are indeed air chambers communicating with the inside of the shoe and allowing the foot to be more or less effectively ventilated during walking in order to oppose to the troublesome, not very hygienic perspiration of the foot. They also provide a more or less strong cushioning effect because of their deflection and expansion back to their original state during walking.

However, in spite of the several solutions brought forward the results are not very satisfactory since a greater rate of foot ventilation would be desirable, avoiding at the same time an excessive deflection of the air chambers which could give the user troubles. Moreover, there arises the need of an air circulation not only limited to the ejection and suction always of the same air but providing a real air change.

The present invention seeks to overcome the above problems and provides a shoe sole of the above-mentioned type in which the arrangement of the air chambers is not limited to the upper or lower side of the sole anymore but takes up the whole thickness of the sole, thus also ensuring an effective shock-resistant action against any soil unevenness on which the foot is laid besides enough ventilation to the benefit of the user's foot.

A second object of the present invention is to provide a sole of the above-mentioned type wherein the air chambers are provided with means capable of exerting a beneficial, tonic action causing the user's feet to be massaged in a more significant manner than heretofore known.

Still another object of the invention is to provide a particularly light, cost-effective shoe sole of simple, sturdy construction being affected by no problems caused by any of its mechanical parts and/or delicate components.

Finally, another object of the invention is to provide a shoe sole wherein the tread is capable of expelling any material stuck on it during walking.

SUMMARY OF THE INVENTION

All of the objects listed above are accomplished according to the present invention by a sole which comprises a plurality of air chambers or hollow spacers generally hemispherically shaped and with a circular plan extending under the sole and forming the tread to replace the common spacing reticulated pattern on the upper side of the sole.

According to another feature of the invention, the shape of a single spacer is similar to that of an igloo with a central hole at the top.

In a preferred embodiment of the invention, a little member projecting towards such central hole and capable of plugging the same during the deflection is provided inside each igloo.

The form of the "igloo"-shaped spacers having a thickness gradually decreasing towards their upper portion as well as the selection of materials capable of being resiliently deformed is such as to create an air circulation with air change under the user's foot sole during walking.

The sole's performance as it was described so far may be summarized as follows: the movement during walking with repeated cycles of the user's weight loading onto and unloading from the foot sole is used to create an air circulation under the foot. In fact each single igloo exerts a pumping action due to its resilient deformation. During the user's weight loading step, the igloos deflect and deform and their reduction in volume causes the air contained therein to be forcibly expelled through the upper hole.

During the following user's weight unloading step, the consequent resilient return causes an air suction with the ensuing filling of the igloos with the air from the shoe.

It should be appreciated that the air circulation is not limited to an expulsion and a suction of the same air to the detriment of a real air change. In fact the lower surface of a fixed insole rests on the igloos so as to form a valve which causes, in the expulsion step, the air pressure to push the edge of the upper holes against the fixed insole preventing the air from escaping sideways and forcing the same to reach the inside of the shoe and the user's foot. In this way, air is prevented from lingering in the gaps among the igloos. In other words, once expelled the air is conveyed through the transpiring frame of the fixed insole.

During the suction step, the shape and the thinness of the edge or lip of the upper holes of the igloos allow fresh air to enter the latter through the openings in the vamp that communicates with the outside.

According to trials and the basic laws of enthalpy it should be appreciated that a real air circulation is established as described above.

Trials carried out on different kinds of shoes have shown that the volume of circulated air is more than good enough to guarantee an effective ventilation of the foot and advantageously reduce the effects of its perspiration.

Another advantage of the invention is that the igloos provide a pleasant, effective massage to the sole of the foot so that blood circulation results to be improved.

BRIEF DESCRIPTION OF THE DRAWINGS

A better understanding of the invention will ensue from the following detailed description with reference to the accompanying drawings which show only by way of example some preferred embodiments.

In the drawings:

FIGS. 2 and 3 show a second and a third embodiments of the invention, respectively.

DETAILED DESCRIPTION OF THE PREFERRED EMBODIMENTS

Figure 1:
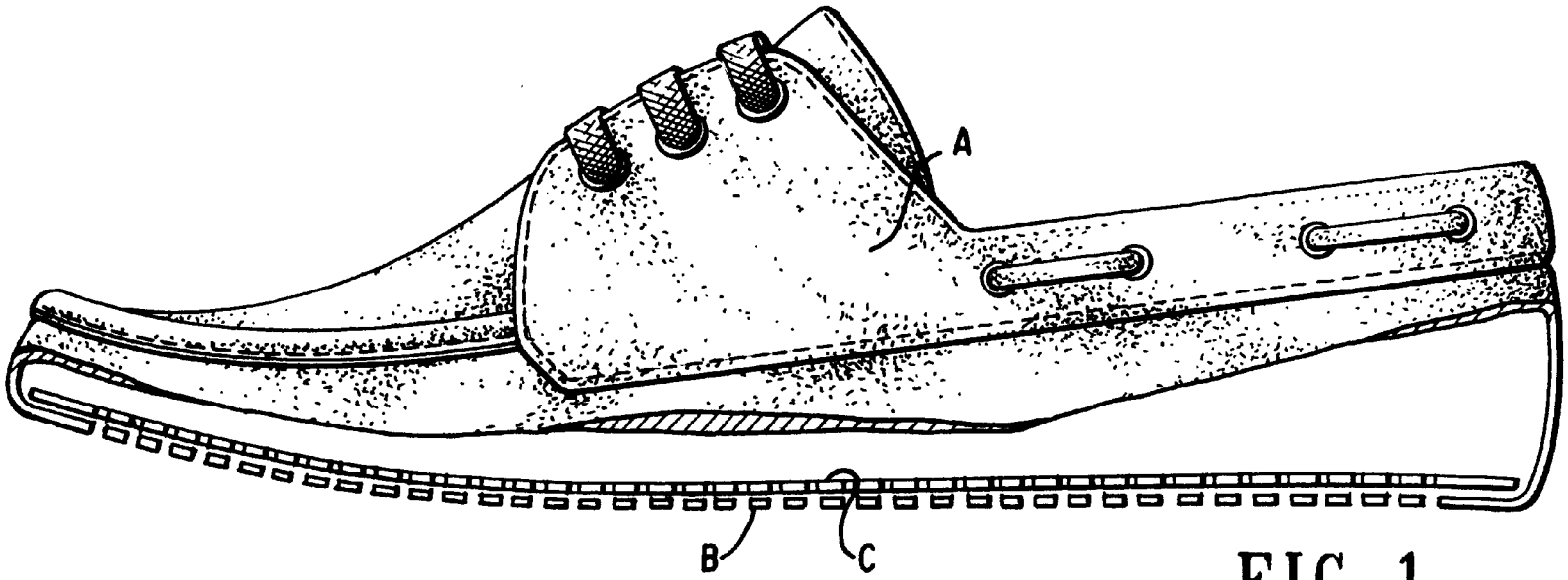
FIG. 1 is a partially sectioned side view of a shoe without a sole.

With reference to FIG. 1, the sole according to the invention is capable of being applied to a winter or summer shoe A, with or without shoestrings which may also be a boot or a sandal provided with a fixed insole B having a series of holes. Such fixed insole B is covered with a so-called cleaning sole C which is perforated.

According to the invention, the air blown in by the sole during walking can flow through the perforation so as to easily reach the inside of the shoe.

Figure 2:
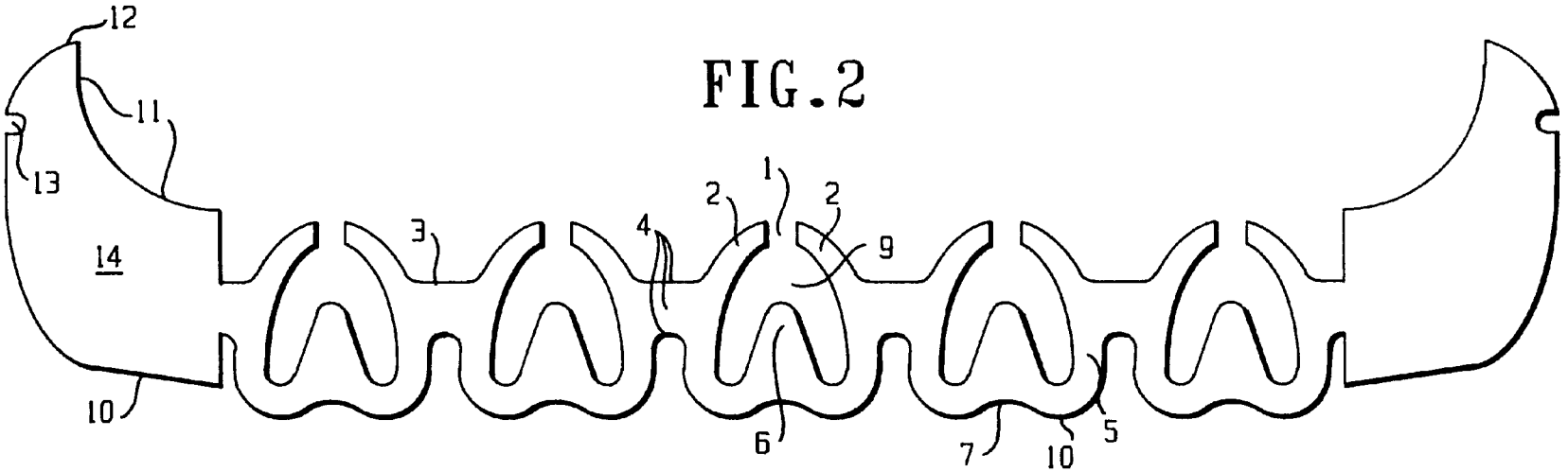
FIG. 2 is a cross section of a first embodiment of the sole according to the invention.
Figure 3:
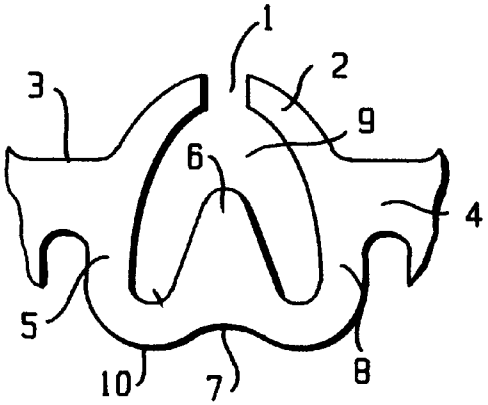
FIG. 3 shows a detail of the sole of FIG. 2.

With particular reference to FIGS. 2 and 3, the sole according to the invention essentially consists of a peripheral rib 14 and a tread 10. The vamp is anchored to said rib 14 by conventional gluing and, if necessary, a sewing.

In a first embodiment the tread includes a number of air chambers which also monolithically extend towards the upper portion of the sole, i.e. that portion on which the perforated fixed insole of the shoe rests.

Each air chamber, hereafter called "igloo", has a tread 10 provided with a central portion 7 shaped as a suction cup. Obviously, such a shape is not the only possible form of that portion as the tread may show different patterns in order to have an antislip function.

The igloos are structurally bound to one another to form the sole by dint of support members 4.

The sole in top plan view shows a series of half-spheres 2 provided with holes 1 at their upper side. When the foot causes them to be deflected during walking, the half-spheres exert a massaging action and at the same time blow air in. In the embodiment described a large amount of air is blown into the air chambers or igloos as the latter have a remarkable volume 9 as a consequence of their lower walls 5 of small thickness resting directly on the ground and acting as a tread. Such "igloos" give a considerable comfort to the foot which always rests on a pleasantly soft surface.

In order to also perform an advantageous shock-resistant action there are essentially provided conical protrusions 6 projecting from the base of each igloo towards their respective upper hole 1. In this way, when the walls 2 and 5 are deflected by the user's weight, each protrusion 6 will occlude the corresponding hole 1 before all of the air in cavity 9 of the igloo escapes. Under these circumstances it is evident that each igloo acts as an airtight hollow body in which the air is the cushioning resilient element.

The operation has a number of steps: one step of soft deflection with simultaneous air blowing into the shoe, a following airtight sealing before the air chambers have been completely emptied, the ensuing resilient cushioning shock-resistant effect, and the subsequent filling after the user's weight has been unloaded and the air sucked through the gaps among the igloos with consequent air circulation during walking.

FIG. 2 also shows upper surface 3 of the sole as well as surface 11 to which the vamp is glued and groove 13 in which the sewing is made.

Figure 4:
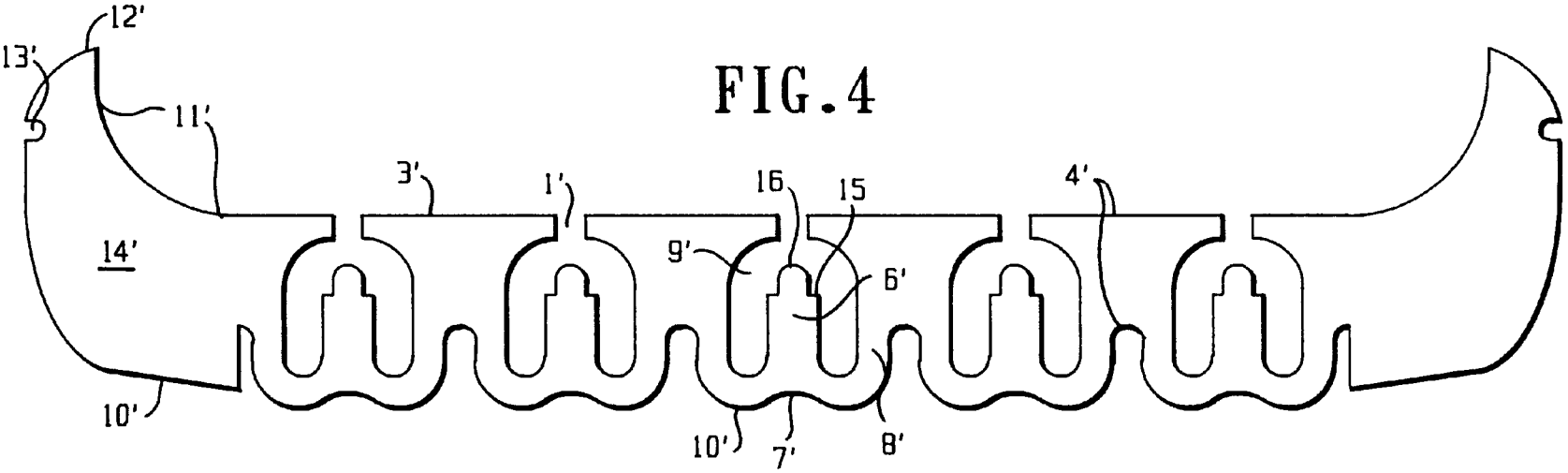
FIGS. 4–5 and 6–7 similar to the preceding
Figure 5:
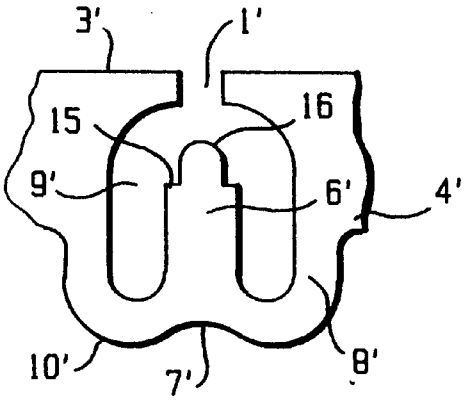

Turning now to FIGS. 4 and 5, in which the construction components corresponding to those already described are designated by the same numerals as those used in FIGS. 2 and 3 with the addition of a prime, the operation is quite similar to that already described above. Even if such a second embodiment bears features found in the first embodiment, it provides igloo-shaped air chambers having a hemispheric upper portion which is wholly located under upper surface 3' of the sole.

In this case also the deflection of the igloos by the user's weight causes air to be blown into the shoe and holes 1' to be then occluded by members 6' so that residual air in cavity 9' is caused to provide the already described resilient shock-resistant action. The projecting members 6' have a different form from that of members 6 of the preceding embodiment as they have a tapered, roundish point 16 at the top of an offset 15. Such an offset aims at occluding holes 1' during the deflection caused by the user's weight on walking in order to produce the already described shock-resistant effect.

In such a second embodiment roundish point 16 of member 6' has a diameter which is shorter than that of hole 1' and such a height as to slightly project from upper surface 3' of the sole when the igloo is deflected and offset 15 occludes hole 1'. In this case member 16 projecting from surface 3' softly strains the lower surface of cleaning sole C of the shoe producing a massaging effect which considerably improves blood circulation of the foot.

Figure 7:
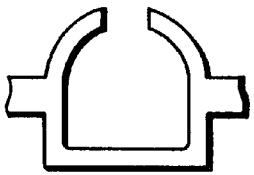
Figure 6:
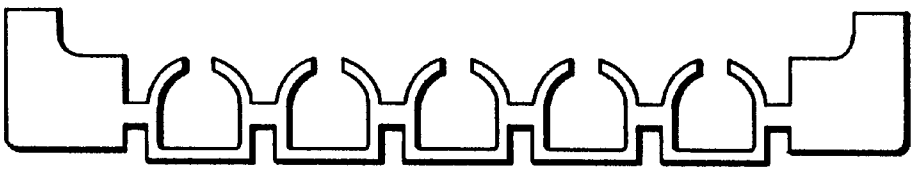

A third embodiment of the invention shown in FIGS. 6 and 7 has essentially the same features as the preceding embodiments but is simplified as it does not provide any member corresponding to member 6 or 6' capable of occluding hole 1 or 1' during walking. In this case the shock-resistant function is only accomplished by the resilient deformation of the igloos that make up the sole.

Figure 8:
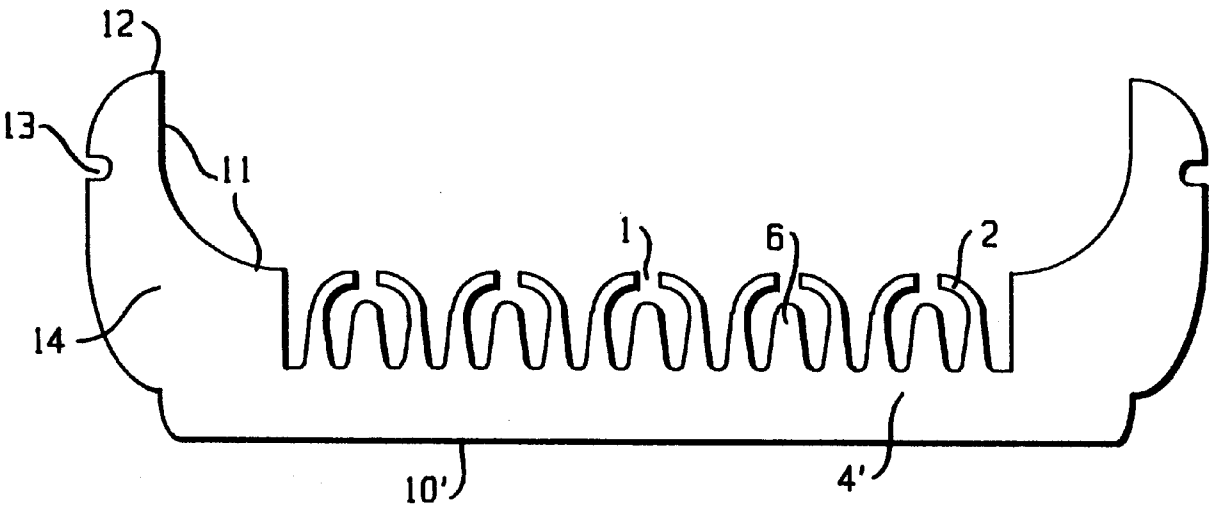
FIG. 8 is a cross section of a fourth embodiment of the sole according to the invention.

A further and last embodiment of the sole according to the invention is illustrated in FIG. 8 and envisages igloos having a common lower portion which forms tread 10' and coincides with support members 4' joining said igloos to one another.

It should be appreciated that igloos having different shapes and/or volumes and/or heights may be advantageously provided in order to satisfy the most diverse technical and/or aesthetic requirements.

In case the igloos have the lower portion projecting so as to form the tread, another advantage is given by that a constant undulating movement of the parts projecting downwards is provided in addition to the pleasant sensation of softness given by the flexibility of the igloos. Such movement gives rise to a good cleaning action against the dirt from the soil which often enters the grooves in the tread.

In case the user stops without walking any longer, still another advantage of the invention is that the air chambers formed by the igloos perform an insulating action keeping the inner temperature of the shoe close to that of the body.

Now it should be pointed out that the sole according to the invention described can be produced in just one moulding step by using resilient material of different kinds capable of being deformed and recovering their original shape immediately after the deformation. Said materials are preferably resistant to abrasions, ultraviolet rays and low temperatures.

Of course, the sole of the invention can be applied to any type of shoe.

Finally, there could be provided soles according to the invention in which the igloo-shaped members are built-up parts and not integral with the remainder of the sole. Particularly said igloos may be formed by materials having specific weight greater than the remainder of the sole.

The present invention has been described and illustrated according to some preferred embodiments thereof, however, it should be understood that those skilled in the art can make equivalent modifications and/or replacements without departing from the scope of the present industrial invention.

What is claimed is:

1. A sole for a shoe (A) comprising:

a perforated insole layer (B) provided with a series of holes and having an upper surface and a lower surface;

an outer sole layer comprising:

a support member layer (4, 4') having an upper surface (3, 3') and a lower surface, and a plurality of resilient hollow air chambers, said air chambers each having internally an upper hemispherically shaped portion, and said air chambers each defining a central upper hole (1, 1') at the top of the hemispherically shaped portion, said air chambers supporting the support member layer, and said air chambers each have a lower portion forming a tread, wherein portions of the support member layer adjacent the air chambers have a thickness defined by the support member layer upper surface and support member layer lower surface, and each air chamber has a height which extends below the lower surface of the portion of the support member layer adjacent the air chamber;

a cleaning sole (C) having holes, wherein said outer sole layer is capable of being fixed to a shoe and said air chambers are capable of being deflected during walking of a user of the shoe by blowing the air contained therein into the shoe through the upper holes (1, 1') of the air chambers and the corresponding holes of the cleaning sole (C) to establish an air circulation and a real air change beneath the user's foot;

wherein during a deflection under a dynamic user's weight the air chambers deform and deflect so that the reduction in their volume causes the air contained therein to be forcibly expelled through their upper hole (1, 1');

wherein said air chambers are resilient such that unloading of the dynamic user's weight on the shoe causes a subsequent resilient return which causes an air suction and then a filling of the air chambers with air from the shoe; and wherein the air circulation is not limited to an expulsion and a suction of the same air to the detriment of a real air change, and the lower surface of the insole layer (B) rests on the air chambers to form a valve which causes, during the expulsion, the air pressure to push an edge of the upper holes against the insole layer (B) preventing the air from escaping sideways and forcing the same to reach the inside of the shoe and the user's foot.

2. The sole of claim 1,wherein an edge or lip of the upper holes of the air chambers have a shape and thinness to allow fresh air to enter therein through openings of a vamp of the shoe communicating with the outside during the suction.

3. The sole of claim 1, wherein each air chamber is connected to the adjacent air chambers by the support member layer (4).

4. The sole of claim 1, wherein each chamber extends above the upper surface (3) of said support member layer.

5. The sole of claim 1, wherein the air chamber has inner side walls and outer side walls and at least upper portions of said chamber inner and outer side walls are hemispherically shaped, and the upper hemispherically shaped portions of said air chambers extend upwardly from the upper surface (3) of the support member (4) layer.

6. A sole for a shoe (A) comprising:

a perforated insole layer (B) provided with a series of holes and having an upper surface and a lower surface; and an outer sole layer comprising:

a support member layer (4, 4') having an upper surface (3, 3') and a lower surface, and a plurality of resilient hollow air chambers, said air chambers each having internally an upper hemispherically shaped portion, and said air chambers each defining a central upper hole (1, 1') at the top of the hemispherically shaped portion, said air chambers supporting the support member layer, and said air chambers each have a lower portion forming a tread, wherein portions of the support member layer adjacent the air chambers have a thickness defined by the support member layer upper surface and support member layer lower surface, and each air chamber has a height which extends below the lower surface of the portion of the support member layer adjacent the air chamber; and wherein each air chamber has walls (2, 5) and a base, and to perform a shock-resistant action there are provided essentially conical protrusions (6) projecting from the base of each air chamber towards the respective upper hole (1) so that when the walls (2, 5) are deflected by the user's weight, each protrusion (6) will obstruct the corresponding hole (1) before all of the air contained in the chamber escapes.

7. The sole of claim 6, wherein an edge or lip of the upper holes of the air chambers have a shape and thinness to allow fresh air to enter therein through openings of a vamp of the shoe communicating with the outside during a suction.

8. The sole of claim 6, wherein each air chamber is connected to the adjacent air chambers by the support member layer (4) to form the sole.

9. The sole of claim 6, wherein the air chamber has inner side walls and outer side walls and at least upper portions of said chamber inner and outer side walls are hemispherically shaped, and the upper hemispherically shaped portions of said air chambers extend upwardly from the upper surface (3) of the support member (4) layer.

10. The sole of claim 6, further comprising a peripheral rib (14) about a perimeter of said tread (10), said rib (14) provided for anchoring to a vamp by conventional gluing and, optionally, anchoring to said vamp by a sewing.

11. The sole of claim 6, wherein said air chamber sidewalls comprise a hemispherically shaped inner surface and a hemispherically shaped outer surface.

12. The sole of claim 6, wherein each chamber extends above the upper surface (3) of said support member layer.

13. The sole of claim 6, wherein each air chamber extends above the upper surface of the portion of the support member layer adjacent the air chamber, and each air chamber has sidewalls and a bottom wall which transverses the sidewalls, and wherein the sidewalls extend below the lower surface of the portion of the support member layer adjacent the air chamber, and the bottom wall is located below the lower surface of the portion of the support member layer adjacent the air chamber.

14. The sole of claim 6, wherein the lower portion of each air chamber has a flexibility which provides a constant undulating movement of the downwards projecting portions, said movement causing a cleaning action against the dirt picked up by grooves of the tread (10).

15. The sole of claim 6, wherein the sole is capable of being attached to a shoe for use by a user for walking and, when the user is not walking, the air chambers perform an insulating action keeping the inner temperature of the shoe close to that of the user's body.

16. A sole for a shoe (A) comprising:

a perforated insole layer (B) provided with a series of holes and having an upper surface and a lower surface; and an outer sole layer comprising:

a support member layer (4, 4') having an upper surface (3, 3') and a lower surface, and a plurality of resilient hollow air chambers, said air chambers each having internally an upper hemispherically shaped portion, and said air chambers each defining a central upper hole (1, 1') at the top of the hemispherically shaped portion, said air chambers supporting the support member layer, wherein portions of the support member layer adjacent the air chambers have a thickness defined by the support member layer upper surface and support member layer lower surface, and each air chamber has a height which extends below the lower surface of the portion of the support member layer adjacent the air chamber;

wherein the lower portion of said air chambers projects from the support member layer to form the tread (10), and a base of the lower portion of the chambers has a central portion (7) shaped as a suction cup.

17. The sole of claim 16, wherein the hemispherically shaped upper portion of each air chamber is wholly located underneath the upper surface (3') of the support member layer, and each chamber comprises projecting members (6') located therein, said projecting members (6') having a tapered, roundish point (16) at the top of an offset (15).

18. The sole of claim 16, wherein the hemispherically shaped upper portion of each chamber is wholly located underneath the upper surface (3') of the support member layer, and projecting members (6') having a tapered, roundish point (16) at the top of an offset (15), said offset (15) having the function of occluding hole (1') during a deflection caused by a user's weight on walking in a shoe to which the sole is capable of being fixed before all of the air contained in the chamber escapes.

19. The sole of claim 18, wherein projecting member (6') has a roundish point (16) with a diameter which is shorter than that of hole (1') and such a height as to slightly project from the upper surface (3') of the outer sole layer when the chamber is deflected and offset (15) occludes hole (1'), wherein the roundish point (16) projecting from the upper surface (3') of the outer sole layer softly strains the lower perforated surfaces of the insole layer (B) and a cleaning sole (C) of the shoe, thus producing a massaging effect which improves blood circulation of a foot of the user.

20. The sole of claim 16, wherein an edge or lip of the upper holes of the air chambers have a shape and thinness to allow fresh air to enter therein through openings of a vamp of the shoe communicating with the outside during a suction.

21. The sole of claim 16, wherein each air chamber is connected to the adjacent air chambers by the support member layer (4).

22. The sole of claim 16, wherein each chamber extends above the upper surface (3) of said support member layer.

* * * * *